US005611667A

United States Patent [19]

Nagamori et al.

[11] Patent Number: 5,611,667

[45] Date of Patent: Mar. 18, 1997

[54] TRANSVERSE FAN

[75] Inventors: Akira Nagamori; Satoru Konno; Hirohumi Horino; Yoichiro Kobayashi, all of Fuji, Japan

[73] Assignee: Kabushiki Kaisha Toshiba, Kawasaki, Japan

[21] Appl. No.: 365,132

[22] Filed: Dec. 28, 1994

[30] Foreign Application Priority Data

Aug. 9, 1994 [JP] Japan ..... 6-187574

[51] Int. Cl.[6] ..... F04D 29/28

[52] U.S. Cl. ..... 416/178; 416/187; 416/200 R; 416/198 R; 416/203

[58] Field of Search ..... 416/178, 187, 416/200 R, 198 R, 203; 415/119

[56] References Cited

U.S. PATENT DOCUMENTS

| | | | |
|---|---|---|---|
| 4,538,963 | 9/1985 | Sugio et al. | 416/203 |
| 5,266,007 | 11/1993 | Bushnell et al. | 415/119 |
| 5,269,655 | 12/1993 | Chang | 416/178 |

FOREIGN PATENT DOCUMENTS

| | | | |
|---|---|---|---|
| 2322734 | 11/1974 | Germany | 416/178 |
| 54-14009 | 2/1979 | Japan | 416/178 |
| 56-6095 | 1/1981 | Japan | 415/119 |
| 59-19838 | 6/1984 | Japan . | |
| 59-39196 | 10/1984 | Japan . | |
| 1-22958 | 7/1989 | Japan . | |
| 3-194196 | 8/1991 | Japan | 416/178 |
| 3-233196 | 10/1991 | Japan | 416/178 |
| 6-129387 | 5/1994 | Japan | 415/119 |
| 2225814 | 6/1990 | United Kingdom . | |

*Primary Examiner*—James Larson
*Attorney, Agent, or Firm*—Foley & Lardner

[57] ABSTRACT

A transverse fan in which a plurality of blades are disposed between disk- or ring-shaped end plates in a circumferential arrangement at fixed mounting pitches in a ring-shaped configuration. Partitions plates are disposed at intermediate portions in the longitudinal direction of the blades such that each of the blades is inclined at fixed angles with respect to a fan axis and mounted at unequal pitches. The transverse fan includes a plurality of multi-bladed impeller units disposed between the disk-shaped end plates. Each of the multi-bladed impeller units has one disk-shaped partition plate having one surface on which a plurality of blades are integrally disposed along a circumferential direction thereof at unequal pitches and inclined at predetermined angles so as to extend along the axial direction of the transverse fan. A plurality of the multi-bladed impeller units are integrally stacked coaxially with each other to form the transverse-fan. The multi-bladed impeller units are integrally stacked one by one in an arrangement such that the units are displaced at predetermined angles with respect to each other around the fan axis.

8 Claims, 8 Drawing Sheets

| | BLADE MOUNTING | BLADE LONGITU-DINAL DIMENSION | TEETH DIRECTION DISPLACE-MENT ANGLE | NOSE GAP | AIR CAPACITY AT 1300 rpm |
|---|---|---|---|---|---|
| A | UNEQUAL | NOT PARALLEL | NONE | 6 mm | 575 $m^3/h$ |
| B | UNEQUAL | NOT PARALLEL | PROVIDED | 5.5mm | 585 $m^3/h$ |
| C (8) | EQUAL | PARALLEL | NONE | 13 mm | 525 $m^3/h$ |
| D (8e) | EQUAL | NOT PARALLEL | NONE | 9 mm | 535 $m^3/h$ |
| E (8f) | UNEQUAL | PARALLEL | NONE | 8 mm | 545 $m^3/h$ |

TRANSVERSE FAN

BACKGROUND OF THE INVENTION

1. Field of the Invention

The present invention relates to a transverse fan suitable for use as an indoor fan of an air conditioner or the like. In particular the invention relates to a transverse fan capable of reducing air blowing noise and improving air blowing performance achieved by improving blade shapes and blade mounting pitches.

2. Prior Art

FIG. 10 illustrates a common example of an air conditioner incorporated with a transverse fan as an indoor fan. In this air conditioner, suction grills 3 and a blow-out grill 4 are disposed at the upper and the lower portions of the front face 2*a* of a body casing 2 of an indoor unit 1 as viewed in FIG. 10. The suction grills 3 and the blow-out grill 4 communicate with one another by a ventilation path 6 in a fan casing 5.

In the ventilation path 6, a transverse fan 8, which serves as an indoor fan, is disposed at the downstream side of an indoor heat exchanger 7. Indoor air drawn into the body casing 2 from the suction grills 3 is subjected to heat exchange, after which the cooled or warmed air is blown out through the blow-out grill 4 to the outdoor side by means of the transverse fan 8, thereby cooling or warming the indoor air.

The conventional transverse fan 8 of this type, for example shown in FIG. 11, is provided with, between a pair of left and right disk-shaped side plates 8*a* and 8*b*, a plurality of longitudinal vanes 8*c*, horizontally mounted parallel to the fan axis O in a circumferential direction with predetermined equal pitches (equal distances). Ring-shaped partition plates 8*d* are disposed in an axial direction of the transverse fan 8 at fixed equal pitches at axially intermediate portions thereof.

The transverse fan 8 constitutes a blower, as shown in FIG. 10, together with the fan casing 5 and a nose 9, and a suction section and a blow-out section are divided at a portion near the two gaps among the nose 9, the fan casing 5 and the transverse fan 8. Particularly, in these two gap sections, because the direction of air flow with respect to the longitudinal blades 8*c* of the transverse fan 8 is reversed, pressure varies largely, causing air blowing noise.

Such pressure variation produces a noise such that the rotation sounds Pa and Pb having large peaks at a frequency (number of blades x rotation number) of the longitudinal blade 8*c* of the transverse fan 8 and a frequency of its harmonic sound occurs so as to have waveforms N of FIG. 14A. Because the pressure variation waveforms is steep, this often results in the production of a harmonic wave (harmonic sound Pb) having this wave as the fundamental wave.

FIG. 14A illustrates an analysis of the blower noise N conducted under the conditions that (a) the transverse fan 8 has, for example, a diameter of 88 mm and an overall length of 593 mm, and (b) there are 35 longitudinal blades used, which are disposed parallel to the fan axis O and rotate at a speed of 20 rotations/sec.

Decreasing the size of the gaps between the transverse fan 8 and the nose 9 and between the fan casing 5 and the fan 8 tends to increase the air capacity per rotation. However, since there is an increase in pressure variation in these gap portions, the rotation noise N level becomes higher, which results in an increase in the harmonic component. The air volume of the gaps increases by a larger increment when it is small to a certain extent, so that there is a tendency, when the air volume is the same, for the noise level to decrease and the blowing performance to improve. When the gaps are made too small, however, the rotation noise N level becomes relatively high, thereby producing unpleasant noises. Therefore, the gaps cannot be made too small.

In a blower using the conventional transverse fan 8 in which the longitudinal direction of the longitudinal blades 8*c* is parallel to the fan axis O direction, the nose 9 and fan casing 5 which form the blower along with the transverse fan 8, are so constructed as being parallel to the fan axis O. Therefore, when each of the longitudinal blades 8*c* passes near each of the gaps between the fan 8 and the nose 9 and between the fan 8 and the fan casing 5, the whole lengthwise dimension thereof passes at the same time in a short time period, so that pressure variations simultaneously occur in the gaps by an amount corresponding to the length of the longitudinal blades 8*c*. The total sum of the pressure variations which occur in one longitudinal blade 8*c* is large. This results in a large distortion in the waveform. Consequently, as shown in FIG. 14A, there is a tendency for harmonic components to occur more frequently. This waveform distortion varies significantly depending on the degree of parallelization of the nose 9, the fan casing 5 and the longitudinal blades 8*c*, often resulting in a large number of harmonic waves and larger variations in size. In other words, in the blower utilizing the transverse fan 8 in which the longitudinal vanes 8*c* are arranged such that they are parallel to the fan axis O, a large difference tends to occur among individual units in the harmonic wave component of the rotation noise N. In general, such harmonic waves, which are mixed in with the noise, have a tendency to produce unpleasant noises. When the gaps between the blade 8*c* and the nose 9 and between the blade 8*c* and the fan casing 5 are decreased in size to increase the air volume, the rotation noise N level increases considerably, with the result that the gaps cannot be made too small, which prevents the air volume from being increased.

To overcome such problems, there are proposed transverse blades such as disclosed in the Japanese Utility Model Publication No. SHO 59-39196, the Japanese Utility Model Laid-Open No. SHO 56-2092 and the Japanese Utility Model Laid-Open No. SHO 56-45196. Like the transverse fan illustrated in FIG. 12, these conventional fans of the disclosed examples have each of their blades 8*f* formed not parallel to the fan axis O. This arrangement produces continuous pressure variations in order to reduce the aforementioned rotation noise N level.

Accordingly, in such conventional transverse fans, since the gap between each blade 8*f* and the nose 9 and between each blade 8*f* and the fan casing 5 are not parallel to the fan axis O, the pressure variations near these gaps do not occur in the blades 8*f* as a whole, but are restricted to the smallest regions of the gaps. Therefore, instantaneous pressure variations are small, which results in smaller waveform distortions in this type of fan than in fans in which the blades are formed parallel to the axis. Therefore, as illustrated in FIG. 14B, it is less frequent that harmonic wave component Pb is mixed in the rotation noise N.

Sound pressures are developed in each blade 8*f* in such a way that continuous phase differences occur in the longitudinal dimension. Therefore, the phase differences are canceled with each other, resulting in a smaller sound pressure sum, so that the fundamental wave of the rotation noise N can be made smaller.

However, since the sound pressure phase differences are produced between a certain distance, it is impossible to completely eliminate the rotation noise N in the entire sound field. In addition, the angle of the blades 8*f* with respect to the fan axis cannot be made large due to manufacturing reasons. This means that the fundamental wave of the rotation noise N cannot be completely eliminated. Therefore, this rotation noise Pa of this frequency alone appears relatively large. Further, in these transverse fans, the mounting pitches of the blades 8*f* in the rotating direction must be the same, so that the fundamental wave Pa of the rotation noise N has only a single frequency, with the frequency characteristic of the blowing noise having a large peak value in this frequency. This produces an unpleasant noise. In other words, as illustrated in FIG. 14B, although almost all of the double wave Pb is eliminated, the fundamental wave Pa alone becomes relatively large.

In another conventional transverse fan 8*g* illustrated in FIG. 13, each blade 8*h* is formed parallel to the fan axis O and at unequal pitches P in the perimetral dimension, i.e. circumferential direction, of each blade 8*h* in order to scatter the rotation noise N to eliminate the unpleasant noise. However, as shown in FIG. 14C, due to the reasons described above, the frequency of the harmonic wave component, which has been scattered in the rotation noise N, tends to be produced more often. In addition, there are large differences in the harmonic wave component among individual blades. Therefore, although the frequencies are actually scattered, the harmonic wave component is heard as an unpleasant noise, so that the desired result is not actually achieved by the scattering.

That is, in the above-described two methods, since the rotation noise N can be reduced, the decreasing of the nose gap allows the air volume to be increased slightly, thereby increasing the blowing performance. However, the using of the first method alone causes the rotation noise fundamental wave N to be increased, while the using of the second method alone causes the number of harmonic waves to be increased. Therefore, the nose gap cannot be made small, which limits the improvement of the performance can be improved.

SUMMARY OF THE INVENTION

An object of the present invention is to substantially eliminate defects or drawbacks encountered in the prior art described above and to provide a transverse fan utilized, for example, for an air conditioning system capable of reducing rotating noise and harmonic waves thereof and improving air blowing capacity.

This and other objects can be achieved according to the present invention by providing a transverse fan in which a plurality of blades are disposed between disk-or ring-shaped end plates in a circumferential arrangement at fixed mounting pitches in a ring-shaped configuration. Partition plates disposed at intermediate portions in the longitudinal direction of the blades, such that each of the blades are inclined at fixed angles with respect to a fan axis and the mounting pitches of the blades are made unequal.

In preferred embodiments, the transverse fan comprises a plurality of or at least one of multi-bladed impeller units disposed between the disk-shaped end plates, each of the multi-bladed impeller unit comprising one disk-shaped partition plate having one surface on which a plurality of blades are integrally disposed along a circumferential direction thereof at unequal pitches and inclined at predetermined angles so as to extend along the axial direction of the fan. A plurality of the multi-bladed impeller units are integrally stacked coaxially with each other to form the fan. The multi-bladed impeller units are integrally stacked one by one in an arrangement being displaced at predetermined angles with each other around the fan axial direction.

The blades of one of outermost impeller units are mounted to one of the end plates and the partition plate of another one of outermost impeller units is formed as another one of the end plates to which a boss portion is formed. A rotation shaft for rotating the transverse fan is operatively coupled to the boss. The end plates are provided with a plurality of grooves along the circumferential direction thereof. Each of the grooves have shapes to be fitted with corresponding blades of the outermost impeller units. Each of the blades of each of the impeller units has a transverse cross section forwardly inclined with respect to a rotating direction thereof and extend in an arc-shaped manner. Front edges of the blades in the rotating direction are integrally molded to the partition plate so as to be linearly inclined at predetermined angles with respect to the fan axis, or inclined at predetermined angles in a curved manner with respect to the fan axis. Each of the blades with a cross section, perpendicular to the axial direction thereof, has a thickness gradually decreasing from the partition plate side to the front end side of the blade.

According to the structures and characters described above of the present invention, since the plurality of blades are formed not parallel to the fan axis by inclining them at one surface of the partition plate, the pressure, which is produced between the gaps formed between the transverse fan, having these blades, and the nose, and between the blades and the fan casing, can be continuously varied. For this reason, the rotation noise of the transverse fan can be reduced. Since the plurality of blades are mounted at unequal mounting pitches in the circumferential dimension of the partition plate, the peak frequency of the rotation noise which has been reduced by the plurality of blades positioned in an inclined manner can be scattered, thus producing less unpleasant sound than the prior art fans.

Because each of the blades and the partition plates (diaphragms) are integrally formed to form a multi-bladed impeller, the precision of the mounting angle between these blades to the partition plates can be stably increased. This results in reduced variations in the blowing performance. In addition, it is not necessary to secure each blade to the partition plates by caulking means in a conventional technique, which allows the setting of large spiral angles of the blades. In addition, since it is not necessary to form a gap for the purpose of caulking the blades to the partition plate, there will be no gaps for the air currents to flow into, which typically produce a whistling sound.

Because the plurality of multi-bladed impellers can be secured by successive stacking thereof in the axial direction, inexpensive impellers can be easily manufactured. In addition, a suitable number of multi-bladed impellers can be selected for the stacking, so that the axial length of the fan can be readily varied. Further, the multi-bladed impellers can be displaced in the circumferential direction when necessary, or in other words, the displacement of each impeller can be readily set, so that the blades can be arranged into a desired form.

Because the thickness of the cross section of each blade, perpendicular to the axis, decreases from the base toward the front end, the frictional force, produced when the multi-bladed impeller is removed from the mold after injection molding, can be reduced. This structure results in easy removal of the impeller from the mold in addition to improved molding ability.

Formation of the blades, themselves, into an arc or curved shape in the longitudinal dimension allows them to be inclined with respect to the fan axis. This results in reduced rotation noise. In addition, stress is no longer applied to the vanes, thus increasing their strength.

The nature and further features of the present invention will be made more clear through the following descriptions made in conjunction with the accompanying drawings.

BRIEF DESCRIPTION OF THE DRAWINGS

In the accompanying drawings.

FIGS. 14A, 14B and 14C illustrate distributions of the rotation noise of the conventional transverse fans of FIGS. 11, 12, and 13 respectively, while

DESCRIPTION OF THE PREFERRED EMBODIMENTS

Figure 1:
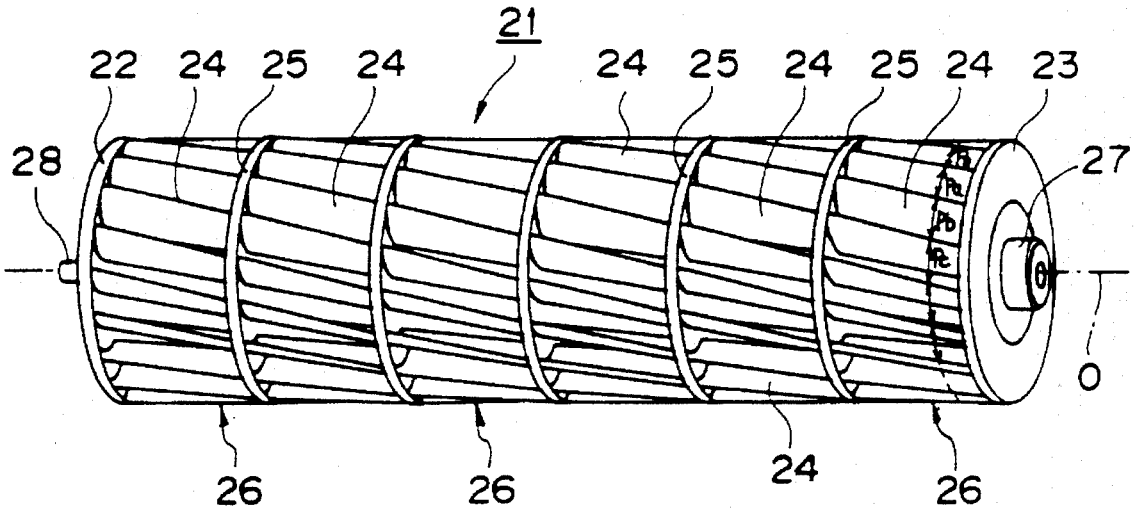
FIG. 1 is a perspective view of one embodiment of a transverse fan according to the present invention.

Preferred embodiments of the transverse fan of the present invention will be described below with reference to FIGS. 1 through 9, in which the same or corresponding parts are denoted with the same reference numerals.

Figure 2:
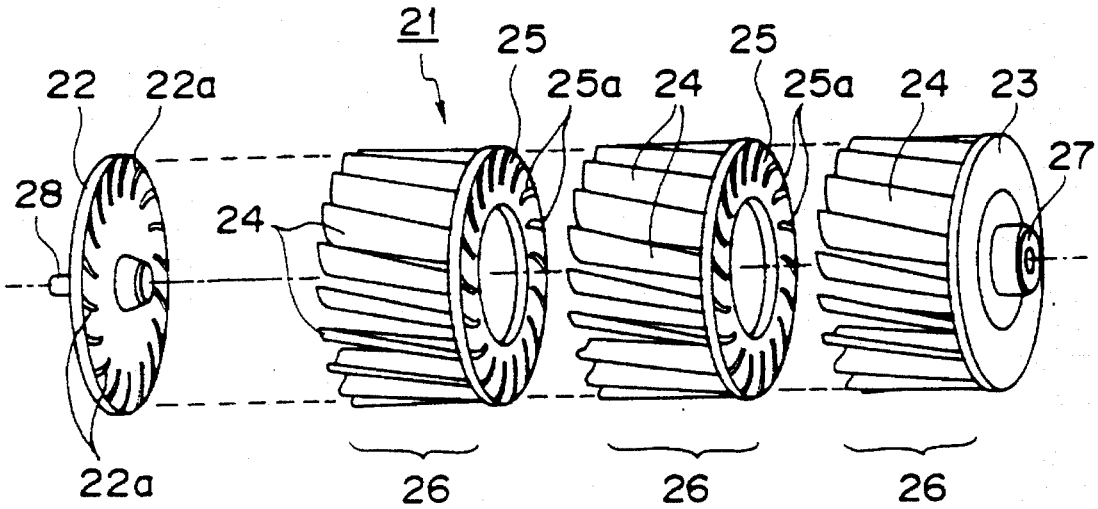
FIG. 2 is an exploded perspective view of the embodiment of FIG. 1.
Figure 3A:
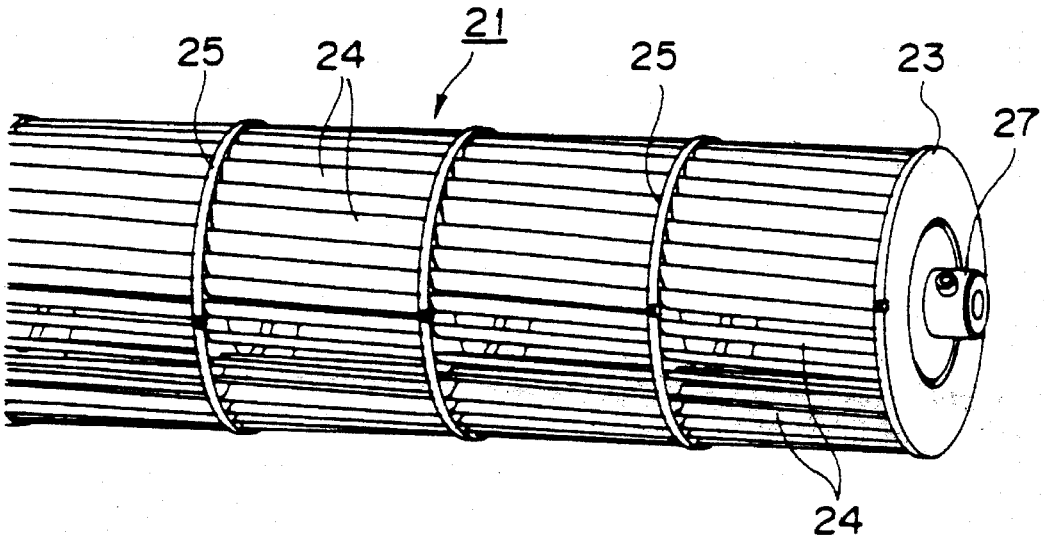
FIGS. 3A and 3B are enlarged perspective views showing one and other ends of the transverse fan of FIG. 1.
Figure 3B:
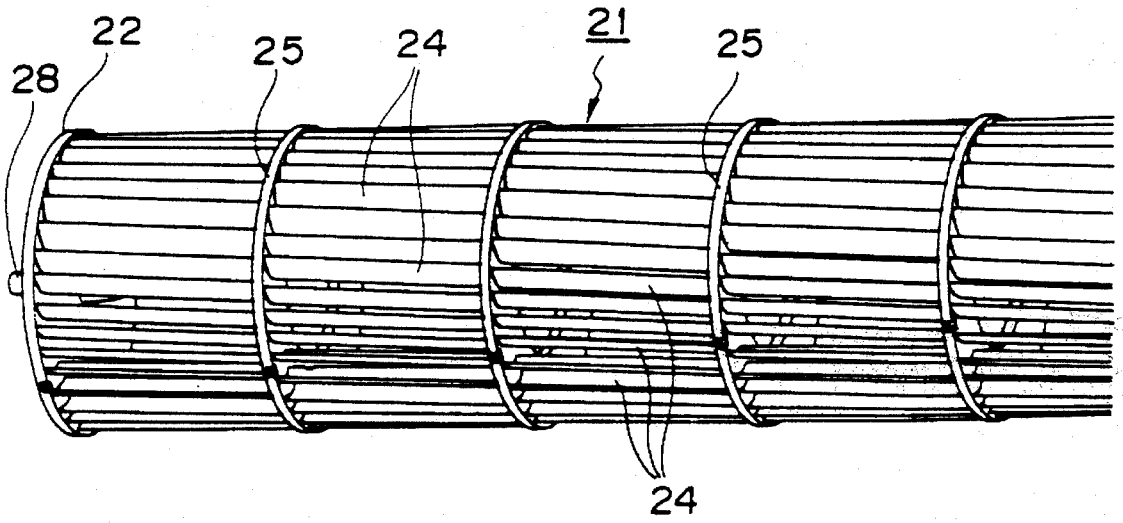
Figure 10:
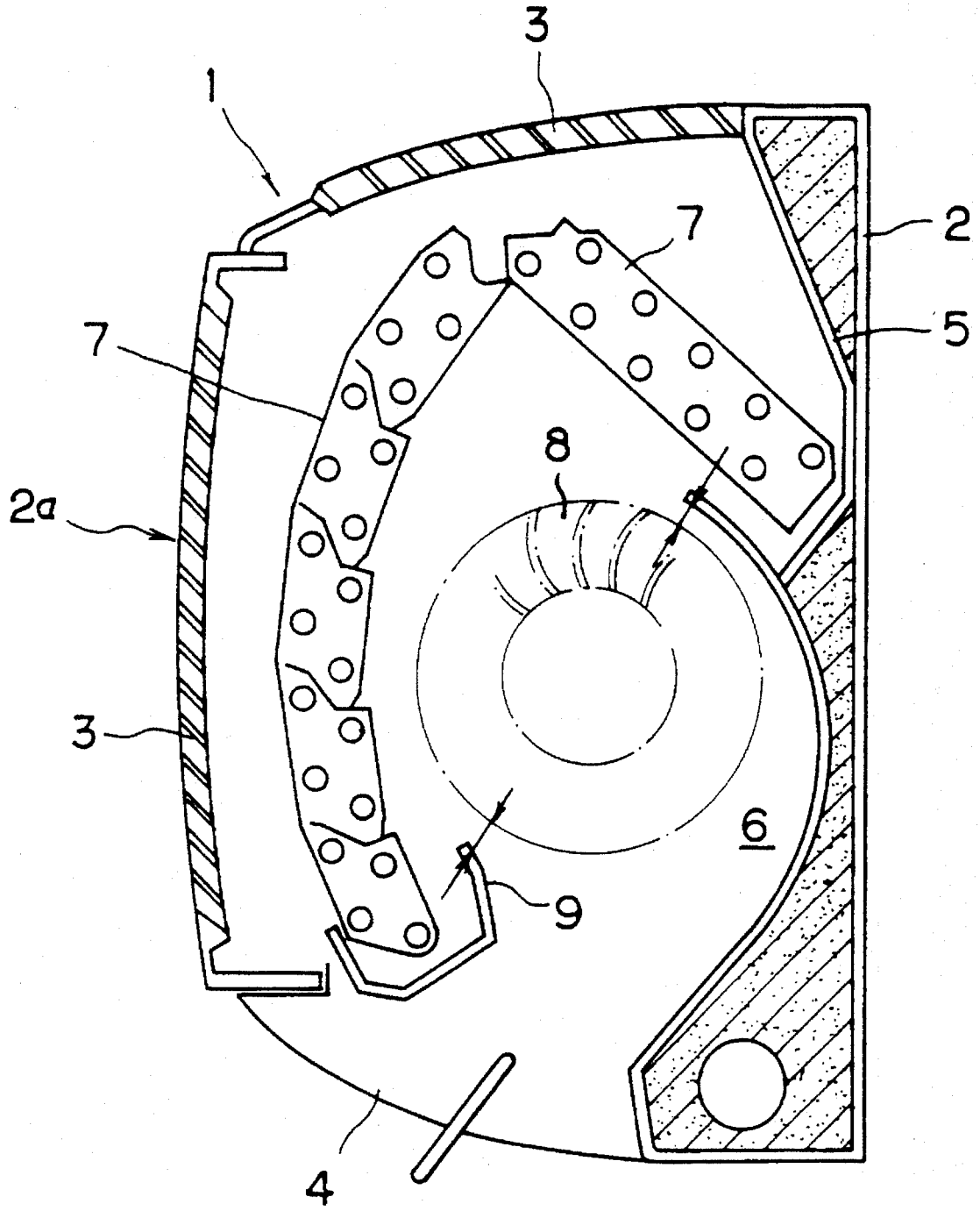
FIG. 10 PRIOR ART
FIG. 10 is a vertical cross section of one example of an indoor unit in a conventional air conditioner.
Figure 11:
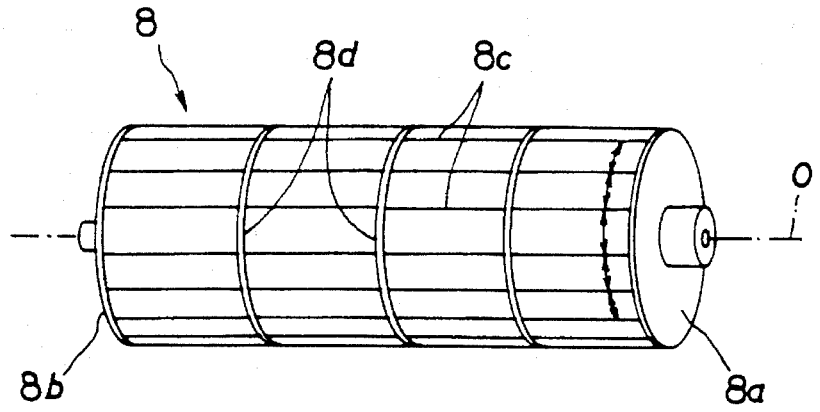
FIG. 11 PRIOR ART
FIG. 11 is a perspective view of the conventional transverse fan illustrated in FIG. 10.
Figure 12:
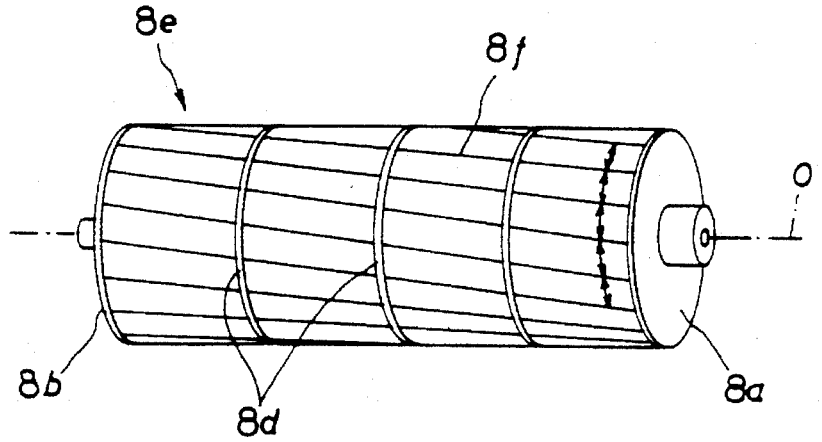
FIG. 12 PRIOR ART
FIG. 12 is a perspective view of another conventional transverse fan.
Figure 13:
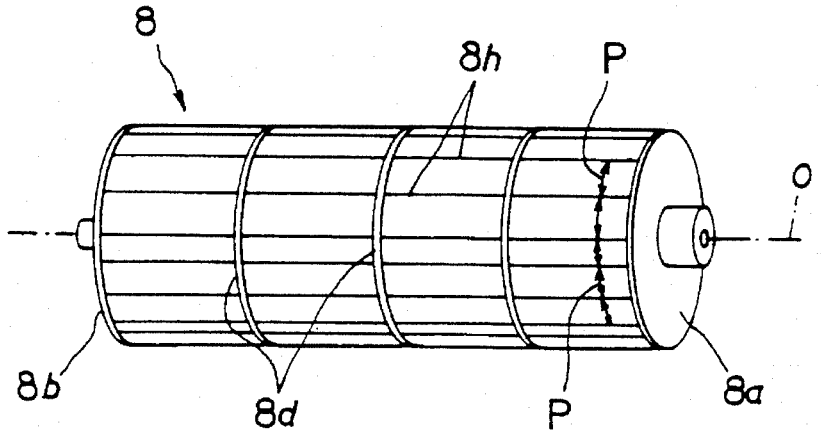
FIG. 13 PRIOR ART
FIG. 13 is a perspective view of a further conventional transverse fan.

Referring to FIGS. 1, 2 and 3 (3A, 3B), a transverse fan 21, having a longitudinal axis O, is a fan suitable for use, for example, as an indoor fan unit built in an indoor system 1 of an air conditioner illustrated in FIG. 10. In this transverse fan, there are provided, between a pair of right and left end plates, a plurality of blades 24 which have a transverse cross section of an arc shape and which are arranged concentrically in a ring-shaped configuration. The plurality of blades are horizontally secured, while being inclined at predetermined angles. Ring-shaped partition plates or diaphragms 25 are placed at intermediate sections in the axial direction of each blade 24 at predetermined pitches in the axial direction. They are capable of causing air to be blown in a direction perpendicular to the axial direction of the fan axis O.

As shown in FIG. 2, the transverse fan 21, has a plurality of multi-bladed impellers 26 that are successively and concentrically fixed one another into an integral construction. In FIG. 2, an end plate 23 is formed, at the right end, as viewed, of the multi-bladed impeller structure, concentrically and integrally or into an integral structure with boss section 27 for removably joining the rotation shaft of such as a motor, not illustrated, by means of, for example, setscrews to the outer surfaces of disk-shaped or ring-shaped partition plates 25.

On the other hand, a left end plate 22 is secured to each of the blades 24 of the multi-bladed impeller 26 by fitting the front ends of the blades into each of the grooves 22*a* which have shapes according with the corresponding blades. A shaft 28 is projected out concentrically and integrally or into an integral structure with the central portion at the outside surface of the left end plate 22.

Figure 4:
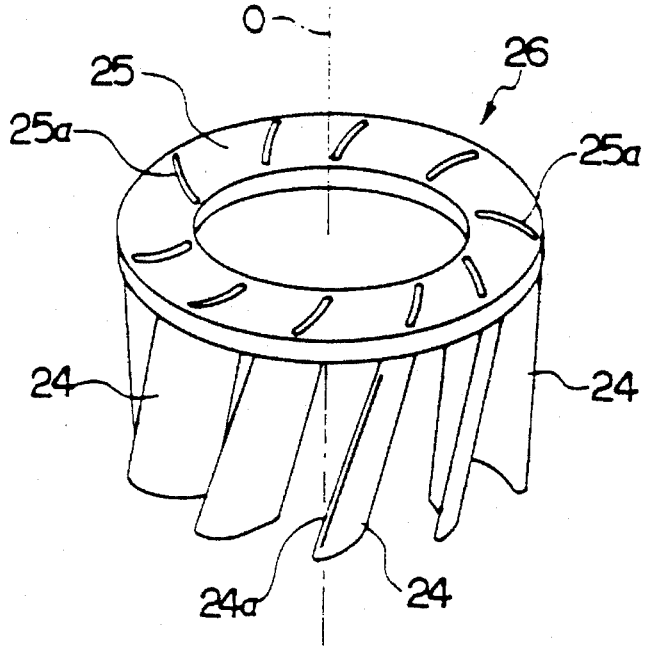
FIG. 4 is a perspective view of one example of the multi-bladed impeller illustrated in FIG. 2.

As shown in FIGS. 2 and 4, on one surface of each ring-shaped partition plate 25 there are provided arc-shaped recess sections 25*a* into which are fitted the front ends of each of the blades 24 of an adjacent multi-bladed impeller 26 for securing them together. On the other surface of each of the partition plates 25, there are integrally provided a plurality of blades 24 in the circumferential direction at required mounting pitches by injection molding or the like.

Figure 5:
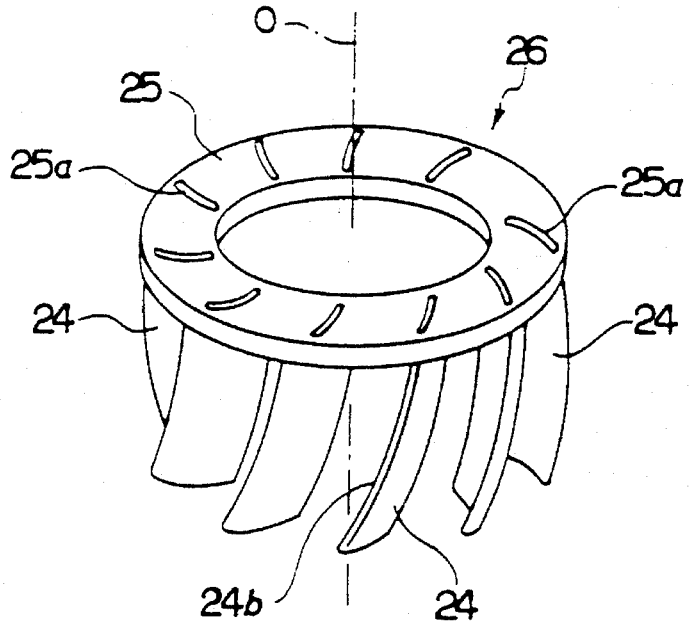
FIG. 5 is a perspective view of another example of the multi-bladed impeller illustrated in FIG. 2.

Each of the blades 24 has its transverse cross section forwardly inclined with respect to the rotating direction thereof and extended in an arc-shaped manner. The blades 24 are integrally molded to the partition plates 25 so that the front edges 24*a* of the blades 24 are linearly inclined in the rotating direction thereof at predetermined angles with respect to the fan axis O. As shown in FIG. 5, however, each of the blades 24 may be integrally molded such that the front edges 24*b* in the rotating direction are inclined in a curved manner.

That is, each of the blades have a curved shape in a direction projecting in the fan rotating direction while maintaining a parallel state with the shaft 28.

Figure 6:
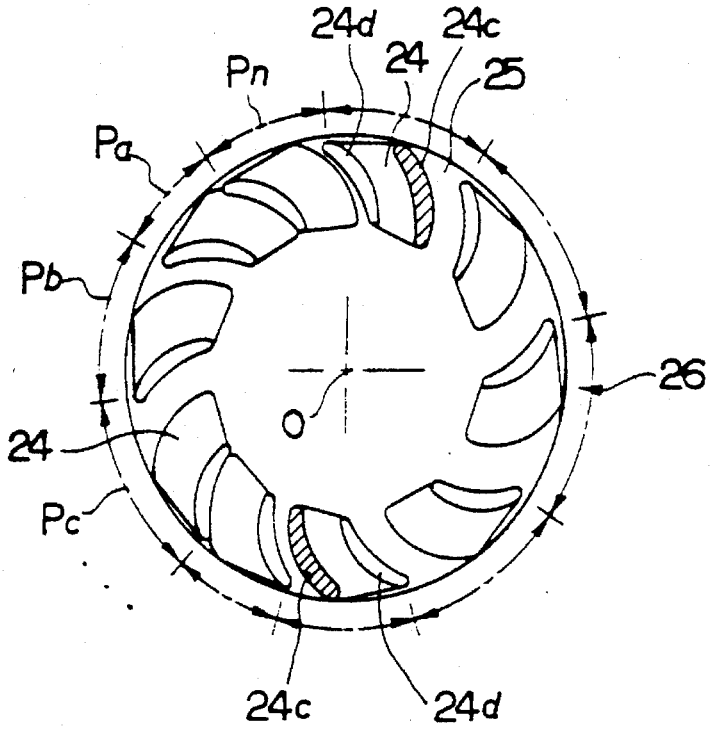
FIG. 6 is a bottom view of FIG. 4.

As shown in FIG. 6 which is a bottom view of FIG. 4, each of the blades 24 is formed such that the thickness of the transverse section (i.e. cross section perpendicular to the axis) decreases gradually from a base section 24*c* at the partition plate of diaphragm side to the front end section 24*d*.

Figure 7:
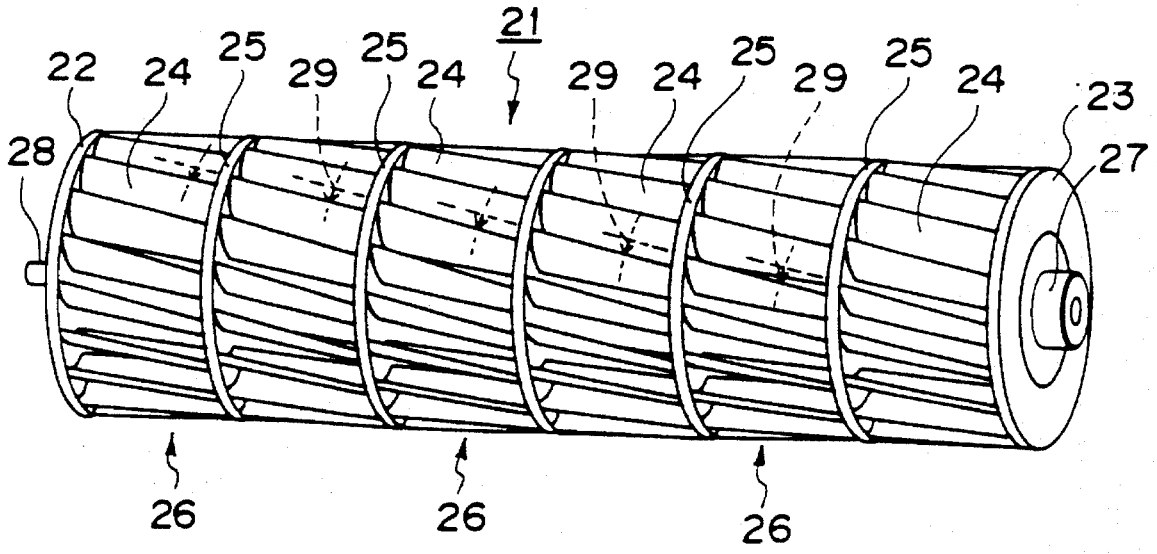
FIG. 7 is a perspective view showing the transverse fan having displacement angles of the embodiment illustrated in FIG. 1.

As shown in FIG. 6, each of the multi-bladed impellers 26 are set at unequal mounting pitches Pa, Pb, Pc . . . Pn in the circumferential direction, i.e. perimetrical dimension, of each of the blades 24 on the partition plates 25. In addition, as shown in FIG. 7, the multi-bladed impellers 26 which are adjacent to each other in the axial direction of the transverse fan 21 may be, for example, successively displaced by predetermined angles 29 in the rotating direction to connect and secure them concentrically.

Figure 14A:
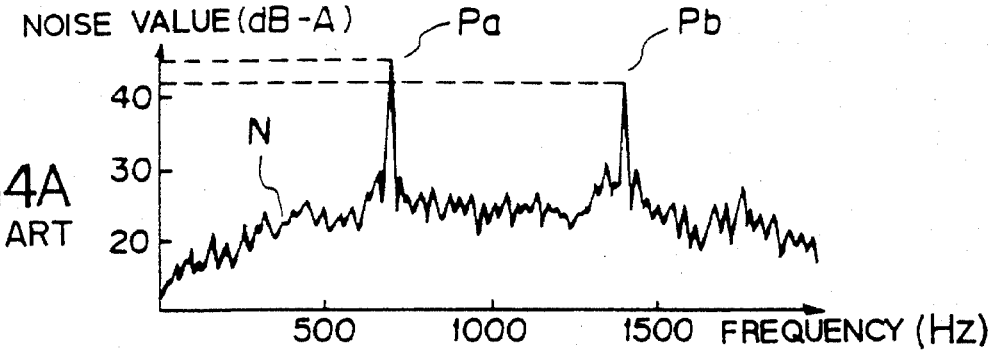
FIG. 14A PRIOR ART
Figure 14B:
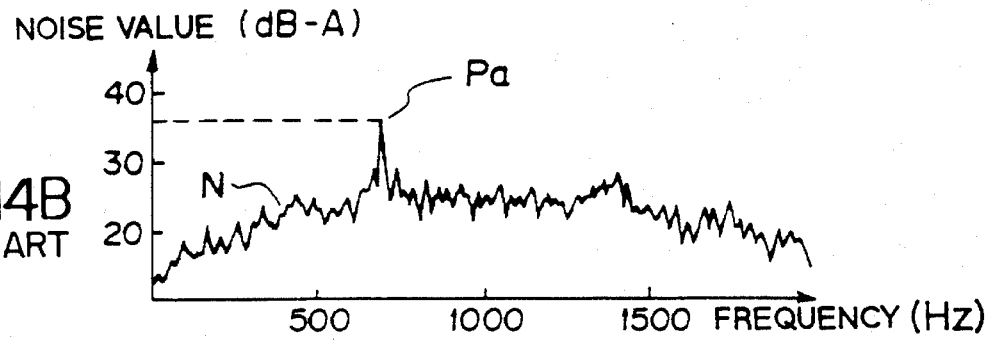
FIG. 14B PRIOR ART
Figure 14C:
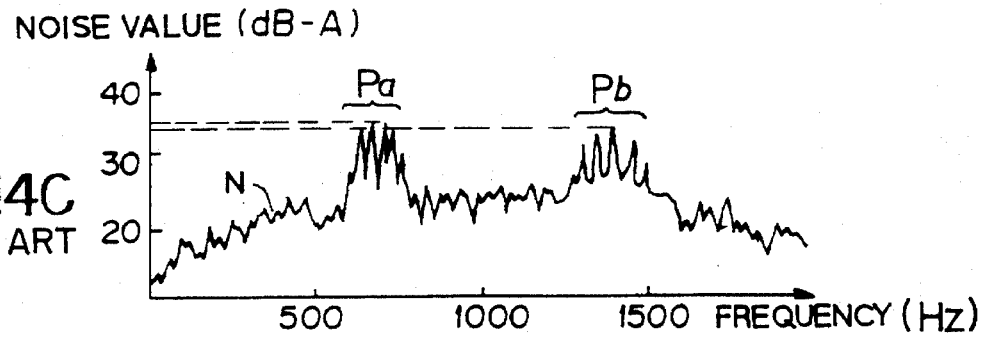
FIG. 14C PRIOR ART

Next, the noise reduction effects of this embodiment will be described with reference to FIGS. 14A through 14E, in which FIGS. 14B through 14E show results of experiments which have been conducted under the same conditions by the same experimental methods used to obtain the experimental data of FIG. 14A, which illustrates a noise distribution of a conventional example. That is, the transverse fan dimensions, the number of blades 24 and the number of rotations per unit time were made the same as those of the conventional example.

Figure 14D:
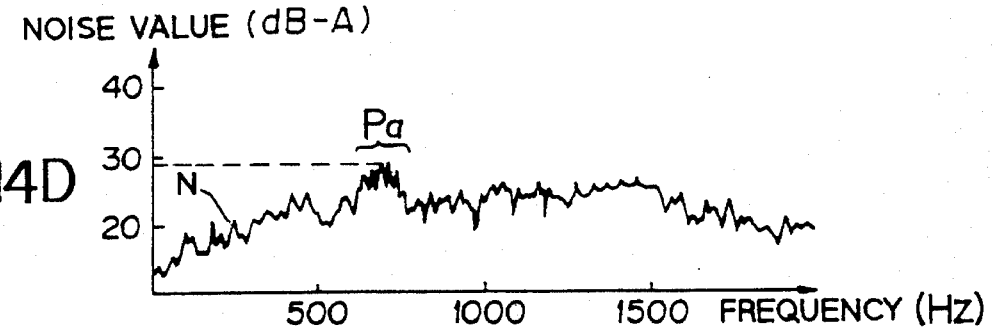
FIGS. 14D and 14E illustrate distributions of the rotation noise of each of the embodiments of the present invention.

As shown in FIG. 1, since in this embodiment each of the blades 24 is inclined and is not in parallel to the fan axis O, pressures, which are generated in the gaps formed by the transverse fan 21 and the nose 9 (in FIG. 10), and by the fan 21 and the fan casing 5 (in FIG. 10), change continuously. Therefore, when the displacement angles 29 are not provided and when each of the blades is mounted at unequal mounting pitches Pa through Pn in the perimetrical dimension, as shown in FIG. 14D, the rotation noise peak value Pa and the harmonic peak value Pb thereof can both be reduced.

In addition, since the plurality of blades 24 are mounted at unequal mounting pitches in the perimetrical dimension, even when the displacement angles 29 are not provided, the inclined configuration of each of the blades 24 allows the reduced peak frequency component of the rotation noise N to be scattered, thereby eliminating the unpleasant sound component.

Figures 8, 9:
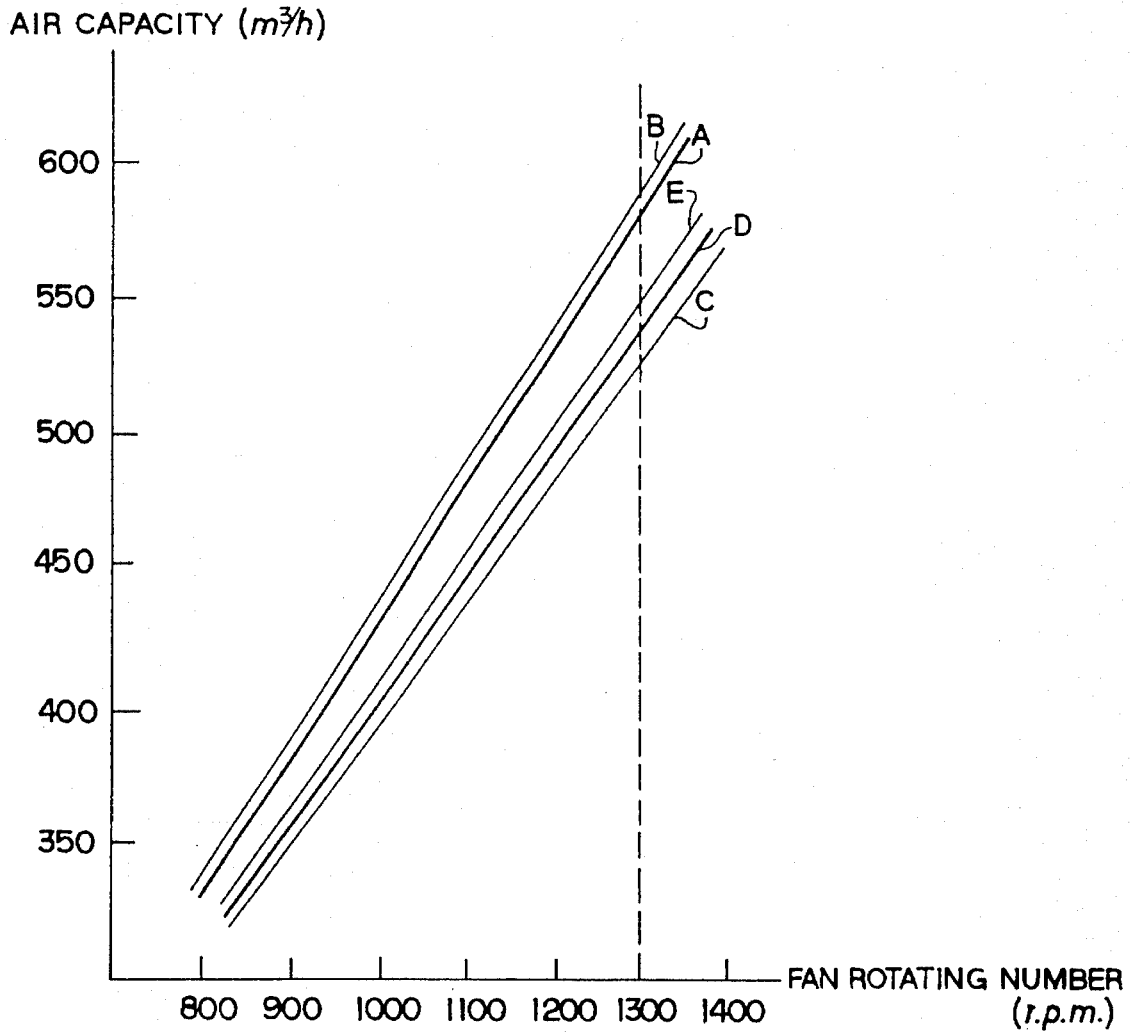
FIG. 8 is a graph in which the blowing performances of each embodiment of the invention is compared with those of the conventional examples.
FIG. 9 is a table in which the blowing performances of each embodiment of the invention are compared with those of the conventional examples.

According to the present embodiment, because the gap formed by the nose 9 illustrated in FIG. 10 can be made small, as indicated by the letter A in FIGS. 8 and 9, the blowing capacity can be greatly increased, thus improving the blowing performance. In FIG. 9, the terms "parallel" and "not parallel" of the blades are used with respect to the fan axis O.

Figure 14E:
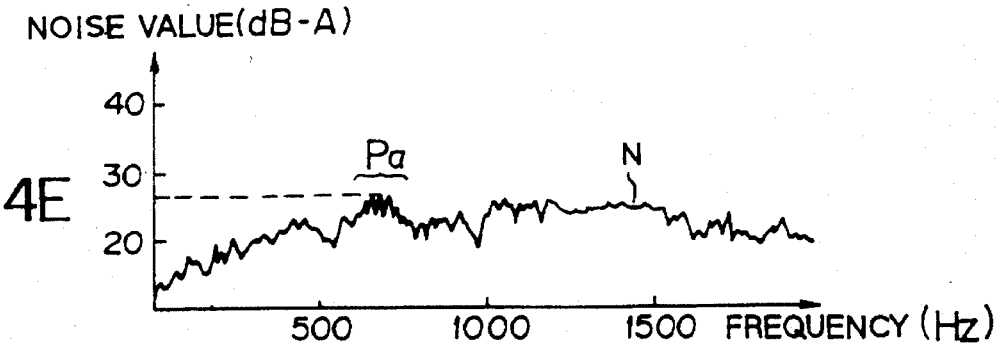

When the plurality of blades 24 are mounted at unequal pitches in the circumferential direction thereof with displacement angles 29, the phase differences of the sound pressure waves, which are produced by the adjacent blades 24 separated by the partition plate 25, can be canceled out by the impeller displacement angles 29. Therefore, as illustrated in FIG. 14E, the inclined configuration of each blade 24 further reduces the rotation noise N, and the frequency component of the remaining blade pitch sound can be scattered, so that unpleasant noise components can be eliminated. In addition, according to this embodiment of the invention, because the gap formed by the nose 9 can be made further smaller, as indicated by the letter B in FIGS. 8 and 9, the blowing capacity can be greatly increased, which in turn further improves the blowing performance. In FIGS. 8 and 9, the letters C, D, and E denote the blowing performances of the transverse fans 8, 8*e* and 8*g*, respectively.

In the embodiment of the invention, because a plurality of multi-bladed impellers 26, provided with the partition plates 25 and the blades 24 formed into an integral structure, are joined and secured to one another, the use of a suitable number of impellers allows the length of the entire transverse fan 21 to be changed easily, and in addition, the selection of the suitable displacement angles also allows the configuration of the blades 24 to be changed very easily, so that manufacturing costs can be reduced.

The integral structure of the blades 24 and the partition plates 25 of the multi-bladed impellers 26 produces the following various advantageous effects.

(1) Because the blades 24 do not need to be subjected to after-treatment, such as being twisted as in the conventional example residual strain does not occur, Hence the blades and the partition plates can be made stronger. In addition, since the mounting angles, etc. between the blades 24 and the partition plates 25 can be made more precise in dimensions in a stable manner, it is possible to reduce variations in the blowing performance.

(2) Because larger helix angles of the blades 24 can be realized compared to the conventional method, the noise level can be reduced considerably. In contrast, in conventional transverse fans whose blades are caulked to the partition plates, a larger helix angle decreases the caulking strength, so that in order to prevent the blades from being largely strained, the blades, themselves, may be arc-shaped in the longitudinal dimension. However, the formation of the blades in such a shape wastes material.

(3) In this embodiment of the invention, an abnormal noise such as a whistling noise which is produced near the partition plate 25 in the conventional examples is not produced. That is, generally speaking, since in the transverse fan 21 the air flows in the axial direction on the face of the blades 24, currents of the air strike strongly against the partition plates. For this reason, it has been common practice to form gaps at places other than the joining point by pressure to increase workability in the conventional caulking method. However, although the conventional examples provides the problem that these currents of the air flow into the gap in the axial direction to produce a whistling sound, in the present embodiment, there are no gaps which pass completely through the partition plates or diaphragms 25, so that such abnormal noise as a whistling sound due to a gap is almost not produced.

Still furthermore, in the present embodiment, because the thickness of the cross section perpendicular to the axis of each of the blades becomes smaller from the base sections 24*c* to the front ends 24*d* thereof, small frictional forces are produced when removing the multi-bladed impellers 26, which have been subjected to injection molding, from the die. This results in easier removal of the impellers and improved molding ability.

Still furthermore, the formation of the blades, themselves, into such a curved form as an arc in the longitudinal dimension makes it possible to incline the blades 24 with respect to the fan axis O. This results in the generation of the reduced rotation noise N. In addition, since the stress applied to the blades are removed, their strength can be increased.

Further, in the described embodiment, although the blades 24 are mounted at unequal pitches in the perimetrical dimension, not all of the mounting pitches Pa through Pn have to be made different, and for example, they may be mounted at pitches of two or more different values in combination. This arrangement may be less effective in removing the unpleasant noise by the scattering of the peak frequency component compared to when the blades are mounted with all of the mounting pitches being different. However, it is more effective than a case where the blades are all mounted at equal pitches.

What is claimed is:

1. A transverse fan comprising:

a pair of disk-shaped end plates;

a plurality of blades extending between said pair of disk-shaped end plates and mounted therebetween in an arrangement along circumferential directions thereof with a central axis of said transverse fan being a center of the circumferential arrangement;

a partition disposed between said pair of disk-shaped plates at an intermediate portion of said plurality of blades;

said plurality of blades being inclined at a predetermined angle with respect to said central axis of said transverse fan and mounted with unequal mounting pitches along said circumferential directions of each of said pair of disk-shaped end plates;

said partition comprising at least one disk-shaped partition plate; and said transverse fan comprising a plurality of multi-bladed impeller units disposed between said pair of disk-shaped end plates, said multi-bladed impeller units being integrally and coaxially stacked;

wherein each of said impeller units comprises a single disk-shaped partition plate of said at least one disk-shaped partition plate, said single disk-shaped partition plate having a surface on which blades of said plurality of blades are integrally molded, said blades being disposed along a circumferential direction thereof at unequal pitches and inclined at predetermined angles with respect to said central axis such that said blades extend along an axial direction of said transverse fan.

2. A transverse fan according to claim 1, wherein said multi-bladed impeller units are integrally stacked one by one in an arrangement being displaced at predetermined angles with each other around said central axis of said fan.

3. A transverse fan according to claim 2, wherein the blades of an outermost impeller unit of said plurality of impeller units is mounted on a first of said pair of disk-shaped end plates; and wherein a partition plate of another one of said plurality of impeller units is formed as a second end plate of said pair of disk-shaped end plates, said second end plate having a boss portion adapted to operatively coupled to a rotation shaft for rotating the transverse fan.

4. A transverse fan according to claim 3, wherein said first end plate is provided with a plurality of grooves along the circumferential direction thereof, said grooves having shapes to be fitted with corresponding blades of said outermost impeller unit.

5. A transverse fan according to claim 3, wherein each of said blades of each of said impeller units has a transverse cross section forwardly inclined with respect to a rotating direction thereof and extends in an arc-shaped manner and front edges of said blades in the rotating direction are integrally molded to said partition plate so as to be linearly inclined at predetermined angles with respect to said central axis of said fan.

6. A transverse fan comprising:

a pair of disk-shaped end plates;

a plurality of blades extending between said pair of disk-shaped end plates and mounted therebetween in an arrangement along circumferential directions thereof with a central axis of said transverse fan being a center of the circumferential arrangement;

a partition disposed between said pair of disk-shaped plates at an intermediate portion of said plurality of blades;

said plurality of blades being inclined at a predetermined angle with respect to said central axis of said transverse fan and mounted with unequal mounting pitches along said circumferential directions of each of said pair of disk-shaped end plates;

said partition comprising at least one disk-shaped partition plate; and said transverse fan comprising a plurality of multi-bladed impeller units disposed between said pair of disk-shaped end plates, said multi-bladed impeller units being integrally and coaxially stacked;

wherein each of said impeller units comprises a single disk-shaped partition plate of said at least one disk-shaped partition plate, said single disk-shaped partition plate having a surface on which blades of said plurality of blades are integrally molded, said blades being disposed along a circumferential direction thereof at unequal pitches and inclined at predetermined angles with respect to said central axis such that said blades extend along an axial direction of said transverse fan;

wherein said multi-bladed impeller units are integrally stacked one by one in an arrangement being displaced at predetermined angles with each other around said central axis of said fan;

wherein the blades of an outermost impeller unit of said plurality of impeller units is mounted on a first of said pair of disk-shaped end plates;

wherein a partition plate of another one of said plurality of impeller units is formed as a second end plate of said pair of disk-shaped end plates, said second end plate having a boss portion adapted to operatively couple to a rotation shaft for rotating the transverse fan; and wherein each of said blades of each of said impeller units has a transverse cross section forwardly inclined with respect to a rotating direction thereof and extends in an arc-shaped manner and front edges of said blades in the rotating direction are integrally molded to the partition plate so as to be inclined at predetermined angles in a curved manner with respect to said central axis of said fan.

7. A transverse fan comprising:

a pair of disk-shaped end plates;

a plurality of blades extending between said pair of disk-shaped end plates and mounted therebetween in an arrangement along circumferential directions thereof with a central axis of said transverse fan being a center of the circumferential arrangement;

a partition disposed between said pair of disk-shaped plates at an intermediate portion of said plurality of blades;

said plurality of blades being inclined at a predetermined angle With respect to said central axis of said transverse fan and mounted with unequal mounting pitches along said circumferential directions of each of said pair of disk-shaped end plates;

said partition comprising at least one disk-shaped partition plate; and said transverse fan comprising a plurality of multi-bladed impeller units disposed between said pair of disk-shaped end plates, said multi-bladed impeller units being integrally and coaxially stacked;

wherein each of said impeller units comprises a single disk-shaped partition plate of said at least one disk-shaped partition plate, said single disk-shaped partition plate having a surface on which blades of said plurality of blades are integrally molded, said blades being disposed along a circumferential direction thereof at unequal pitches and inclined at predetermined angles with respect to said central axis such that said blades extend along an axial direction of said transverse fan;

wherein said multi-bladed impeller units are integrally stacked one by one in an arrangement being displaced at predetermined angles with each other around said central axis of said fan;

wherein the blades of an outermost impeller unit of said plurality of impeller units is mounted on a first of said pair of disk-shaped end plates;

wherein a partition plate of another one of said plurality of impeller units is formed as a second end plate of said pair of disk-shaped end plates, said second end plate having a boss portion adapted to operatively couple to a rotation shaft for rotating the transverse fan; and wherein each of said blades of each of said impeller units has a cross section, perpendicular to the axial direction thereof, having a thickness gradually decreasing from said partition plate side to a front end side of the blade.

8. A transverse fan comprising:

a pair of disk-shaped end plates;

a plurality of blades extending between said pair of disk-shaped end plates and mounted therebetween in an arrangement along circumferential directions thereof with a central axis of said transverse fan being a center of the circumferential arrangement;

a partition disposed between said pair of disk-shaped plates at an intermediate portion of said plurality of blades;

said plurality of blades being inclined at a predetermined angle with respect to said central axis of said transverse fan and mounted with unequal mounting pitches along said circumferential directions of each of said pair of disk-shaped end plates;

said partition comprising at least one disk-shaped partition plate; and said transverse fan comprising a plurality of multi-bladed impeller units disposed between said pair of disk-shaped end plates, said multi-bladed impeller units being integrally and coaxially stacked;

wherein each of said impeller units comprises a single disk-shaped partition plate of said at least one disk-shaped partition plate, said single disk-shaped partition plate having a surface on which blades of said plurality of blades are integrally molded, said blades being disposed along a circumferential direction thereof at unequal pitches and inclined at predetermined angles with respect to said central axis such that said blades extend along an axial direction of said transverse fan; and wherein each of said blades of each of said impeller units has a transverse cross section forwardly inclined with respect to a rotating direction thereof and extends in an arc-shaped manner and front edges of said blades in the rotating direction are integrally molded to the partition plate so as to be inclined at predetermined angles in a curved manner with respect to said central axis of said fan.

* * * * *